US005303747A

United States Patent [19]

Arndt et al.

[11] Patent Number: 5,303,747

[45] Date of Patent: Apr. 19, 1994

[54] WEAVING LOOM WITH A GUIDE FOR GUIDING A GRIPPER HEAD TRAVELLING THROUGH A SHED

[75] Inventors: Stephan Arndt; Rainer Finger, both of Lindau/B, Fed. Rep. of Germany

[73] Assignee: Lindauer Dornier Gesellschaft mbH, Lindau/B, Fed. Rep. of Germany

[21] Appl. No.: 21,154

[22] Filed: Feb. 22, 1993

[30] Foreign Application Priority Data

Feb. 28, 1992 [DE] Fed. Rep. of Germany ..... 4206212
Feb. 28, 1992 [DE] Fed. Rep. of Germany ..... 4206213

[51] Int. Cl.[5] ..... D03D 47/00
[52] U.S. Cl. ..... 139/449; 139/446
[58] Field of Search ..... 139/446, 449

[56] References Cited

U.S. PATENT DOCUMENTS 4,010,776 3/1977 Flamand ..... 139/449
5,176,185 1/1993 Rheinganz et al. ..... 139/449

FOREIGN PATENT DOCUMENTS 0204274 12/1986 European Pat. Off. .
0402285 12/1990 European Pat. Off. .
1710292 10/1971 Fed. Rep. of Germany .
3901549 5/1990 Fed. Rep. of Germany .
62-62953 3/1987 Japan ..... 139/449

*Primary Examiner*—Andrew M. Falik
*Attorney, Agent, or Firm*—W. G. Fasse; W. F. Fasse

[57] ABSTRACT

A gripper head travelling through a shed in a weaving loom, has a longitudinal lateral guide surface (14A, 17A) along its gripper head body which is temporarily contacted by guide lever fingers in those positions of the head where its proper guidance is most critical, e.g. at the time of the weft transfer. The guide lever fingers are so driven by a drive mechanism that these fingers are withdrawn from the loom shed just as soon as the weft transfer is completed.

6 Claims, 3 Drawing Sheets

WEAVING LOOM WITH A GUIDE FOR GUIDING A GRIPPER HEAD TRAVELLING THROUGH A SHED

FIELD OF THE INVENTION

The invention relates to a weaving loom with a guide for guiding a gripper head travelling through a shed in the weaving loom. The gripper head is driven either by a gripper rod or by a gripper tape, whereby the transfer of the weft thread from one gripper head to the other takes place in the center of the loom shed.

BACKGROUND INFORMATION

It is essential that the two gripper heads do not collide with each other when they come closest to each other in the center of the shed for the transfer of the weft thread. Thus, proper guiding of the gripper heads is essential. Two basic possibilities are available for solving this problem. In the majority of tape gripper head looms very light flexible synthetic material tapes are used for carrying a gripper head at one end of the tapes which are guided over the entire weaving width in so-called guide teeth. The guide teeth are so arranged that during the travel of the gripper these teeth grip from below through the warp threads of the lower shed. The guide teeth are rigidly connected with the reed beam carrying a plurality of reeds to form a slay. When the slay is in the beat up position, the guide teeth dip below the warp threads of the lower shed. In connection with the just described structures, reference is made to European Patent Publications 0,204,274 (Pezzoli), published Dec. 10, 1986, and 0,402,285 (Riolet), published Dec. 12, 1980.

The type of gripper guide as described above has the disadvantage that the guide teeth dip below the warp threads of the lower shed only relatively shortly before the slay comes into the beat up position, whereby the lower shed warp threads do not tense-up fast enough before the beat-up. Thus, there is the danger that irregularities occur in the finished fabric in those positions corresponding to the point where the guide teeth dip under the lower shed warp threads since the latter are insufficiently tense at the time of beat-up. Such irregularities may appear in the form of stripes or the like. Another disadvantage of the just described construction is seen in that a relatively large number of guide teeth closely spaced is necessary in order to properly guide a gripper head travelling along with a flexible tape.

It is desirable that the gripper guiding is safe and positive along the entire weaving width, even when the weaving width is rather broad and even when high speed looms are involved.

Another possibility of guiding the gripper through the shed involves making the two gripper tapes substantially stiffer than the tapes that are guided by the guide teeth mentioned above. For this purpose it is known to use the reed beam sole as a sliding guide surface for the gripper head. The warp threads of the lower shed also run across the reed beam sole. Rearwardly, the gripper heads are also guided if desired by a guide piece connected to the respective gripper head and riding along the reed or reed blades. However, in this type of construction there is no guiding at all or just a minimal guiding in an upward direction and in the direction of the beat up motion.

The above described type of guiding has the disadvantage that the gripper head can be relatively easily brought out of its path by the vibrations of the loom. This problem becomes the more aggrevated the broader the loom is and the faster the loom operates. However, wide weaving widths and a fast operation are an economic necessity.

German Patent Publication 1,710,292 corresponding to U.S. Pat. No. 3,665,975 (Kokkinis), patented May 30, 1972 discloses control levers of a device for the positive controlling of the weft thread transfer from one gripper head to the other. These control levers reach through the warp threads of the lower shed. This type of arrangement is an improvement over the above mentioned construction, because irregularities in the fabrics, such as stripes or the like are avoided. This avoidance is accomplished in that the control levers are withdrawn out of the lower shed immediately after the transfer of the weft thread from one head to the other. That is, the withdrawal of the control levers takes place substantially before the actual beat up or weft binding takes place.

Further, one should take into account that a positive guiding of the gripper heads or of the tapes or rods carrying these heads is actually only necessary until the proper transfer of the weft thread from one head to the other has taken place without any collision of the two gripper heads. Thereafter, that is, during the reverse and outward motion of the grippers, it is no longer critical if there are small deviations from the ideal track of the grippers. German Patent Publication 1,710,292 mentions the possibility that the above control levers may perform, in addition to their controlling the gripper clamping lever, a function of centering or fixing the position of the gripper rod during the thread transfer or thread take over. However, a solution for such centering of the position of the gripper rods is not disclosed in this reference. German Patent Publication 3,901,549 (Gerhring), published May 23, 1990 further discloses a gripper with a guide element made of wood and attached to the gripper on its side facing the reed. The purpose of the wood piece is to provide a stabilizing guide along the reed blades for the gripper head as it carries the weft thread into the shed. As a result, the gripper head travels with its wooden guide element along the reed during its alternating back and forth movements into and out of the shed. This type of construction has several disadvantages. One disadvantage is seen in that the particular configuration and securing of the wooden guide element to the gripper is problematic. Another disadvantage is seen in that the individual reed blades of the slay are exposed to a continuous wear and tear by the friction with the wooden guide element.

OBJECTS OF THE INVENTION

In view of the above it is the aim of the invention to achieve the following objects singly or in combination:

- to properly guide a gripper head on its way into the loom shed regardless whether the gripper head is carried by a rod or by a tape;
- to assure a precise transfer of the weft thread from one gripper head to the other, thereby avoiding any contact between the gripper heads when they come closest to each other; and
- to avoid exposing the individual reeds to wear and tear by any guiding elements of the gripper heads as much as possible.

SUMMARY OF THE INVENTION

The weaving loom with its gripper head guiding apparatus according to the invention is characterized in that each gripper head is provided, in addition to its main guide surface, along one of its longitudinal sides with an additional guide surface which is in sliding guide contact with guide levers that are movable, for example, tiltable, into the lower shed and out of the lower shed in a controlled manner. Such guiding is applied only when and where it is needed.

The construction for guiding the gripper heads according to the invention has the advantage that a weft thread transfer free of any faults is assured without any collision of the two gripper heads as they meet in the center of the loom for the weft thread transfer. Another advantage, compared to the prior art, is seen in that the guide levers can be tilted out of the shed even shortly after the thread transfer in the center of the shed. Thus, the guide levers move to a position below the warp threads forming the lower shed. The point of time when the guide levers pass through the lower shed is so selected that a sufficiently long time period is available prior to the actual beat up of the weft thread, or rather prior to the binding of the weft thread into the fabric and the change of the shed. Thus, the warp threads forming at that time the lower shed, have sufficient time to return into their desired original position before the beat up or binding occurs, whereby defects in the fabric are avoided. This was not possible in the guides according to the prior art. Conventionally, the guides dipped below the lower shed only at the time of beat up or weft binding.

The guide arrangement according to the invention is useful for the intended purpose along the entire weaving width, not only in the area of the weft thread transfer. Thus, the gripper can now be guided even prior to entry into the shed, but primarily it is guided with the entry into the shed all the way to the return point where the thread transfer takes place, whereby the tilting of the guide levers out of the lower shed takes place as soon as the weft thread has been transferred. Further, according to the invention, the gripper head itself as well as the gripper rod, or gripper tape, can be guided as taught herein.

According to a further embodiment of the invention, the guide mechanism comprising the rocker shaft (4), the bearing (4), and the guide lever, as well as the drive for the guide lever, including the coupling and drive rod the cam follower lever, the cam follower roller, and the drive cam are positioned in the movement range of the gripper rods or tapes. In this embodiment the gripper head itself is not directly guided in the weft thread transition area. However, an indirect guide is provided by the guiding of the gripper rod or of the tape carrying the gripper head.

Incidentally, the details of the drive mechanism as such are described in detail in German Patent Publication 1,710,292, which is incorporated herein by reference.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
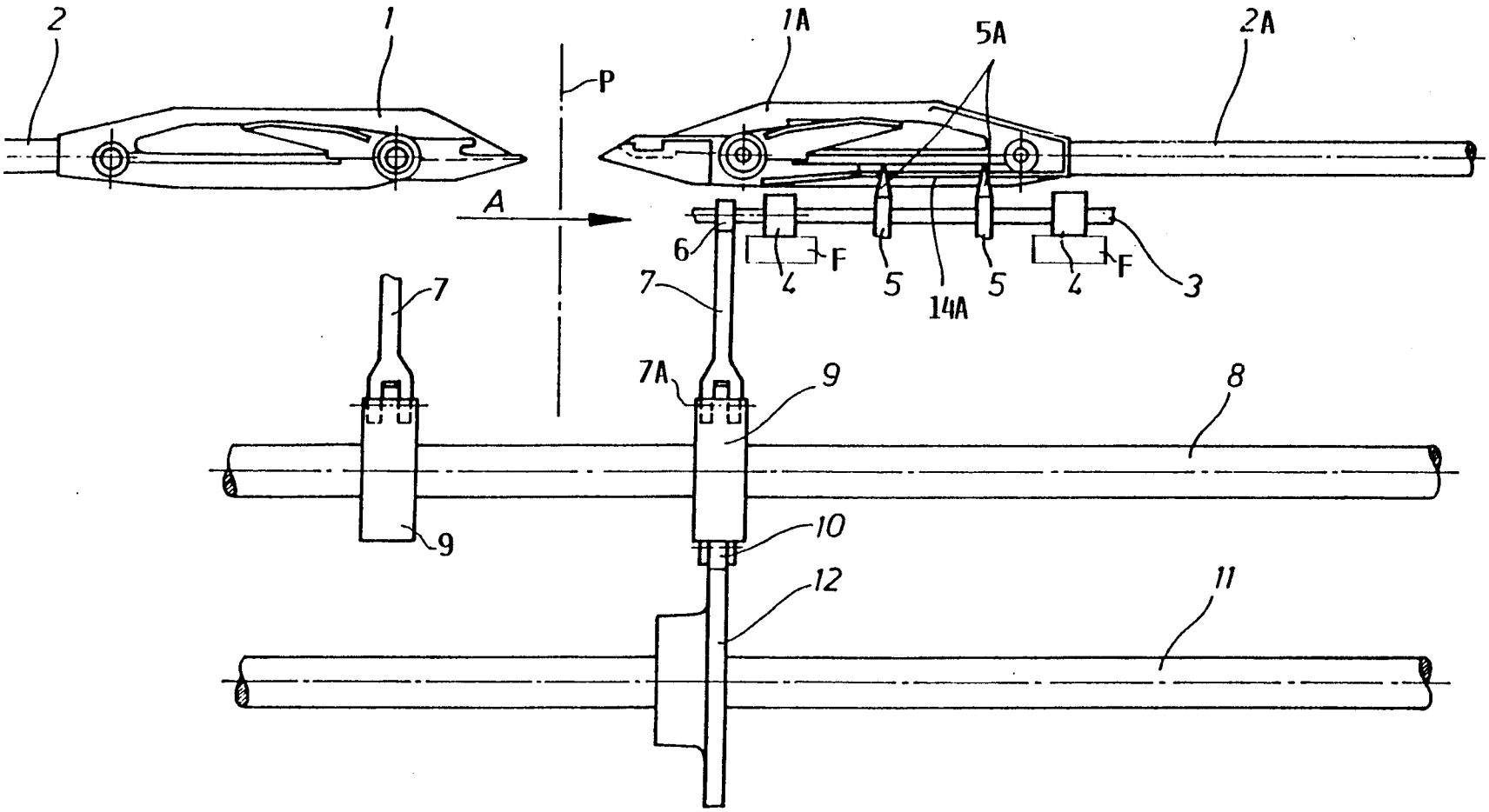
FIG. 1 shows a plan view onto the two gripper heads, each carried by its rod, and each guided as taught herein, however, only the guidance components for one gripper head are shown.

Referring to FIG. 1, the transfer of a weft thread takes place at the plane P shown by dash-dotted lines. The gripper head 1 has a gripper head body with a main guide surface travelling on a slay sole 19A shown in FIG. 2. The gripper head 1 carried by its gripper rod 2 brings the weft thread into the shed and transfers the weft thread to the gripper head 1A carried by its gripper rod 2A for carrying the weft thread through and out of the shed. Both heads 1 and 1A are guided according to the invention. However, only the guide components for the head 1A are shown in FIG. 1. The guide components for the head 1 are constructed and arranged mirror-symmetrically to the components of the head 1A relative to the transfer plane P. Therefore, it is sufficient to describe but one set of components. The head 1A also has a main guide surface travelling on the slay sole 19A.

Spaced somewhat to the right and left of the transfer plane P there is arranged a rocker shaft 3 mounted in bearings 4 secured to the loom frame only symbolically indicated at F. The rocker shaft 3 carries at least one, preferably several, guide levers 5 which contact with their guide fingers 5A an additional longitudinal guide surface 14A of the respective gripper head 1, 1A. The guide levers 5 and thus the guide fingers 5A are axially spaced, from one another along the rocker shaft 3. A drive including the rocker shaft 3 rocks the shaft 3 with a rocker arm 6 which in turn is driven by a drive rod 7 pivoted to the rocker arm 6 at its upper end in FIG. 1 and journalled at 7A to a cam follower lever 9 carrying a cam follower roller 10 that follows the surface of a cam drive 12. The cam follower lever 9 is rigidly secured to a slay shaft 8 conventionally supported in bearings in the loom frame F. The cam drive 12 is rigidly mounted on the drive shaft 11 of the loom. The just described drive mechanism is shown and described in more detail in the above mentioned German Patent Publication 1,710,292. The cam follower lever 9 rotates in unison with the slay shaft 8 so that it performs the rocking motion of the slay shaft in response to the cam drive 12, which is rigidly connected to the loom drive shaft 11 and rotates therewith. The control is such that the guide levers 5 with their fingers 5A are moved by the drive rod 7 and rocker arm 6 through the lower shed formed by the lower warp threads 13, to contact the additional guide surface 14A of the respective gripper head, whereby head 1A, while the latter slides along the slay sole 19A. The fingers 5A remain in contact with the additional guide surface 14A until the fingers are again withdrawn from the shed through spaces between the lower shed or warp threads 13.

Figure 2:
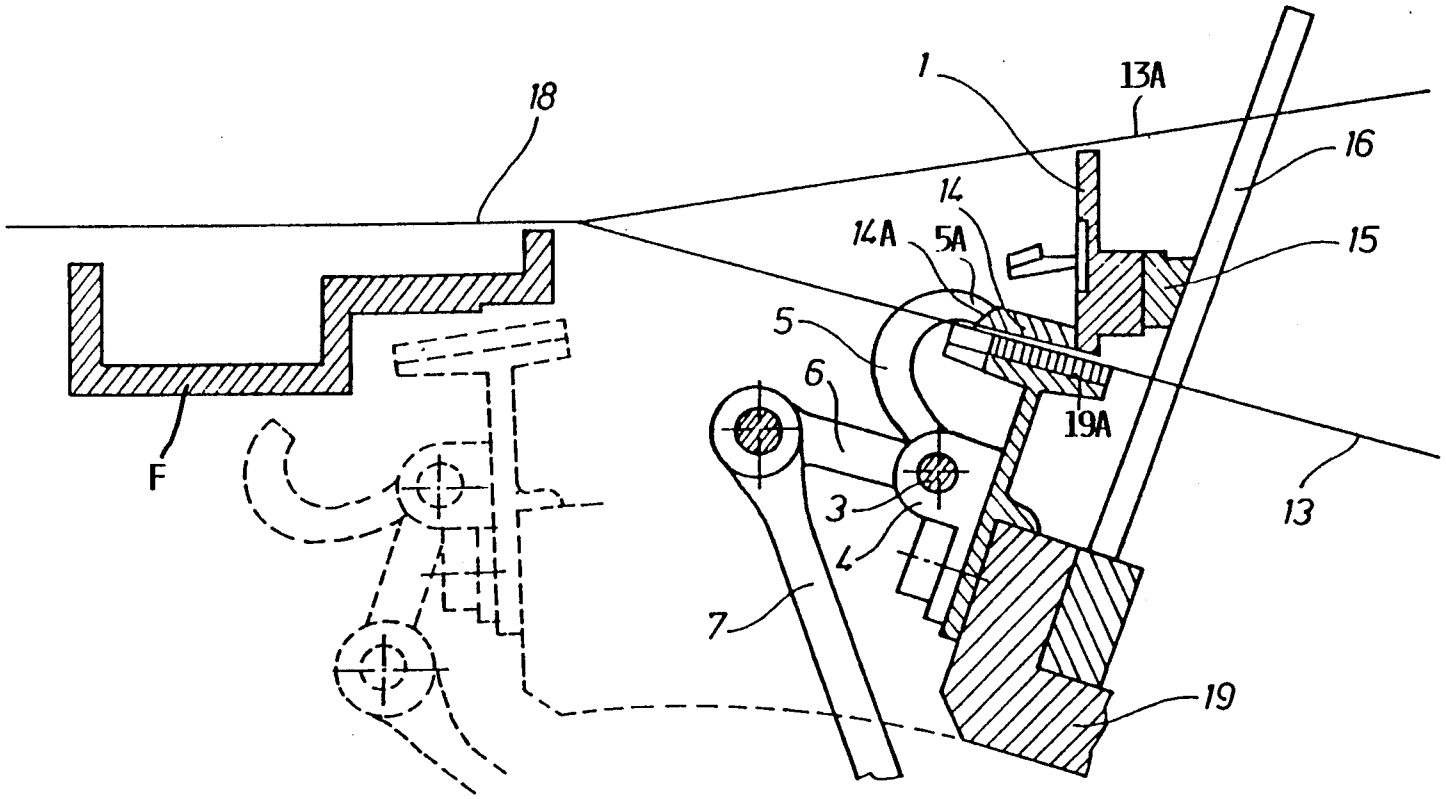
FIG. 2 is a view in the direction of the arrow A in FIG. 1, showing the guide lever in its guiding position.

FIG. 2 shows the contact between the guide finger 5A of the guide lever 5 with the additional longitudinal guiding surface 14A of the gripper head 1A. The position shown is that immediately prior to a thread transfer. The guide surface 14A of the head 1A is formed along a side surface of a guide shoe 14 forming part of the gripper head 1A. The downwardly facing surface of the shoe 14 is in guiding contact with an upwardly facing surface of a guide member forming the above mentioned slay sole 19A secured to the reed beam 19 of the slay 16.

If desired, a wooden guide block 15 may also be used for contacting the reeds of the slay 16. The upper shed is formed by the upper weft threads 13A.

Figure 3:
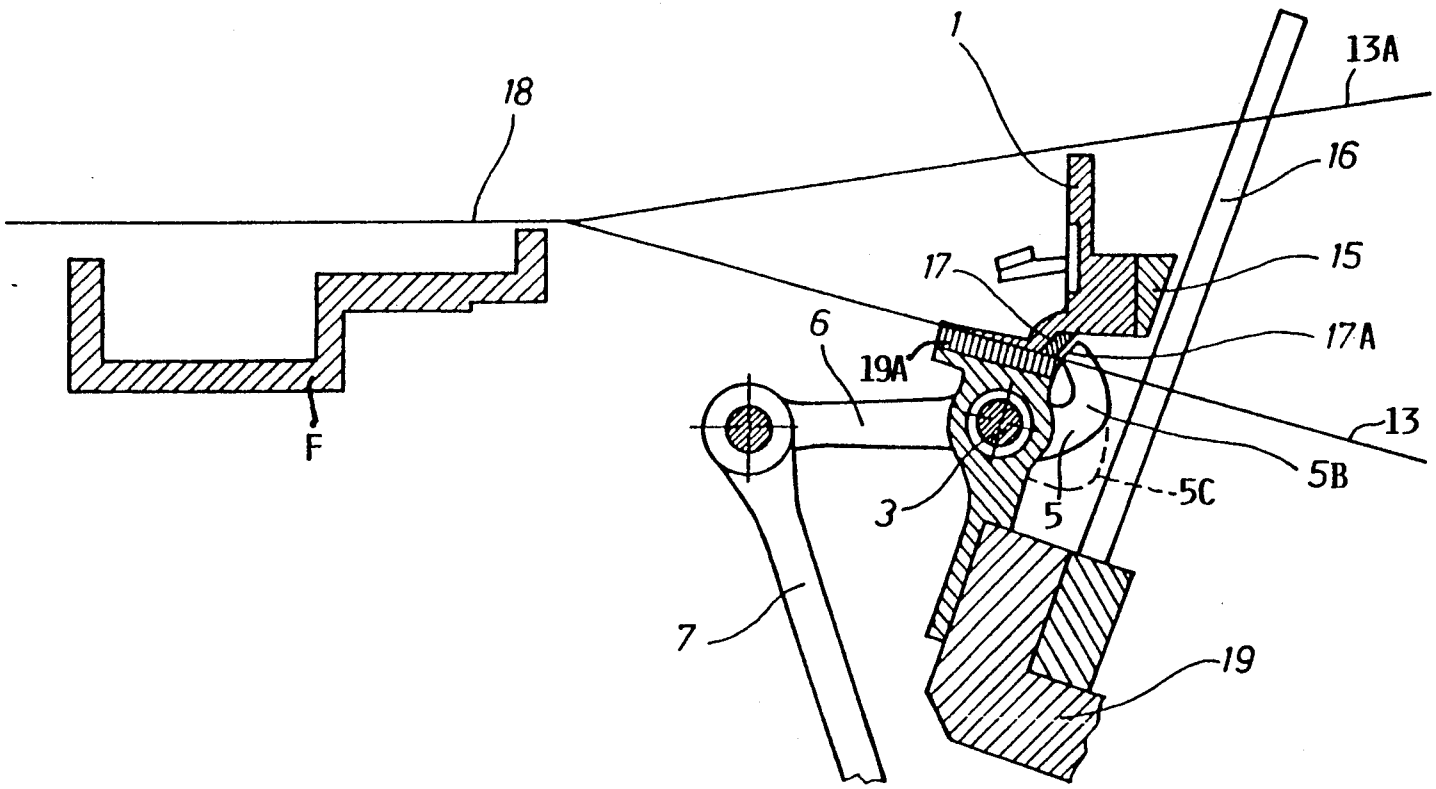
FIG. 3 is a view similar to that of FIG. 1, however, illustrating a modified arrangement of the guide lever shown in its guiding position.

FIG. 3 is a view similar to that of FIG. 2, however, illustrating a modified arrangement of guide fingers 5B cooperating with a guide surface 17A forming part of a guide shoe 17. The guide shoe 17 may be a separate element of a friction reducing material to improve the sliding contact with the guide fingers 5B. The dashed line 5C shows the guide fingers 5B out of the shed in a position below the lower shed weft threads 13. Although a wooden guide block 15 is shown in FIG. 3, its use is optional.

In both embodiments of FIGS. 2 and 3, the guide levers 5 are rigidly secured to the rocker shaft 3 so as to follow the movements of the rocker shaft 3 imparted to the latter by the rocker arm 6. The drive and the control of the guide levers with their fingers in FIG. 3 is otherwise the same as described above with reference to FIG. 2.

Although the invention has been described with reference to specific example embodiments it will be appreciated that it is intended to cover all modifications and equivalents within the scope of the appended claims.

What is claimed is:

1. A weaving loom, comprising a gripper head travelling through a shed in said weaving loom, a slay with a slay sole, said gripper head including a gripper head body having a main guide surface travelling on said slay sole, at least one additional longitudinal guide surface (14A, 17A) on said gripper head body, guide lever means (5) for temporarily contacting said at least one additional longitudinal guide surface as said gripper head moves through said shed, and a loom drive including drive means for moving said guide lever means into and out of a position in which said guide lever means contact said at least one additional longitudinal guide surface.

2. The weaving loom of claim 1, wherein said slay comprises a reed beam (19), said drive means comprising a rocker shaft (3) journalled in said weaving loom, said slay further comprising a slay shaft (8) journalled in said weaving loom in parallel to said rocker shaft (3), means rigidly securing said guide lever means (5) to said rocker shaft (3) in the vicinity of said reed beam, and wherein said drive means dip said guide lever means (5) in and out of said shed in response to a beat-up motion of said slay.

3. The weaving loom of claim 2, wherein said drive means comprise a rocker arm (6) and a drive rod (7), said rocker shaft (3) of said drive means being rigidly connected to one end of said rocker arm (6), said rocker arm (6) having another end operatively connected to said drive rod (7).

4. The weaving loom of claim 3, wherein said drive means further comprise a cam follower lever mounted on said slay shaft (8), said drive rod (7) cooperating with said cam follower lever (9), said cam follower lever (9) carrying a cam follower roller (10), said loom drive comprising a loom drive shaft (11) and a cam drive (12) rigidly secured to said loom drive shaft (11), said cam follower (10) being positioned in operative cam following contact with said cam drive (12).

5. The weaving loom of claim 1, wherein said drive means operate said guide lever means (5) to contact said gripper head along said additional longitudinal guide surface (14A, 17A) at least during a weft thread transfer.

6. The weaving loom of claim 1, wherein said drive means operate said guide lever means (5) to contact said additional longitudinal guide surface (14A, 17A) at least once while said gripper head is travelling through said loom shed.

* * * * *